US009382765B2

(12) United States Patent
Parsche

(10) Patent No.: US 9,382,765 B2
(45) Date of Patent: Jul. 5, 2016

(54) APPARATUS FOR RECOVERING HYDROCARBON RESOURCES INCLUDING FERROFLUID SOURCE AND RELATED METHODS

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 224 days.

(21) Appl. No.: 13/942,361

(22) Filed: Jul. 15, 2013

(65) Prior Publication Data

US 2015/0013985 A1 Jan. 15, 2015

(51) Int. Cl.

| | |
|---|---|
| ***E21B 36/04*** | (2006.01) |
| ***E21B 43/24*** | (2006.01) |
| ***E21B 17/18*** | (2006.01) |

(52) U.S. Cl.

CPC ..... *E21B 17/18* (2013.01); *E21B 43/2401* (2013.01)

(58) Field of Classification Search

CPC ..... E21B 43/24; E21B 43/2401
USPC ..... 166/248
See application file for complete search history.

(56) References Cited

U.S. PATENT DOCUMENTS

| | | | | |
|---|---|---|---|---|
| 4,144,935 | A * | 3/1979 | Bridges et al. | 166/248 |
| 4,508,168 | A * | 4/1985 | Heeren | E21B 36/04 166/248 |
| 5,829,519 | A * | 11/1998 | Uthe | 166/60 |
| 6,853,263 | B2 | 2/2005 | Brown et al. | |
| 6,930,568 | B2 * | 8/2005 | Snyder et al. | 333/156 |
| 7,441,597 | B2 | 10/2008 | Kasevich | |
| 7,640,980 | B2 | 1/2010 | Vinegar et al. | |
| 8,210,256 | B2 * | 7/2012 | Bridges | 166/248 |
| 2004/0125019 | A1 * | 7/2004 | Rawnick | H01Q 1/38 343/700 MS |
| 2007/0137852 | A1 * | 6/2007 | Considine et al. | 166/60 |
| 2010/0078163 | A1 | 4/2010 | Banerjee | |
| 2010/0294488 | A1 | 11/2010 | Wheeler et al. | |
| 2010/0294489 | A1 | 11/2010 | Dreher, Jr. et al. | |
| 2012/0125607 | A1 * | 5/2012 | Parsche | 166/272.1 |

OTHER PUBLICATIONS

Pulse Electronics/Larsen Antennas, Antenna Basic Concepts.*

* cited by examiner

*Primary Examiner* — Angela M DiTrani
*Assistant Examiner* — Avi Skaist
(74) *Attorney, Agent, or Firm* — Allen, Dyer, Doppelt, Milbrath & Gilchrist, P.A.

(57) ABSTRACT

A device for recovering hydrocarbon resources in a subterranean formation may include a radio frequency (RF) source, a ferrofluid source, and an RF applicator coupled to the RF source and configured to supply RF power to the hydrocarbon resources. The RF applicator may include concentric tubular conductors defining ferrofluid passageways therebetween coupled to the ferrofluid source.

16 Claims, 5 Drawing Sheets

APPARATUS FOR RECOVERING HYDROCARBON RESOURCES INCLUDING FERROFLUID SOURCE AND RELATED METHODS

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided, namely an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example.

Moreover, despite the existence of systems that utilize RF energy to provide heating, such systems may suffer from inefficiencies as a result of impedance mismatches between the RF source, transmission line, and/or antenna. These mismatches become particularly acute with increased heating of the subterranean formation. Moreover, such applications may require high power levels that result in relatively high transmission line temperatures that may result in transmission failures. This may also cause problems with thermal expansion as different materials may expand differently, which may render it difficult to maintain electrical and fluidic interconnections.

SUMMARY OF THE INVENTION

In view of the foregoing background, it is therefore an object of the present invention to provide a hydrocarbon resource processing apparatus that provides more efficient hydrocarbon resource recovery and increased heat removal.

This and other objects, features, and advantages in accordance with the present invention are provided by an apparatus for recovering hydrocarbon resources in a subterranean formation. The apparatus includes a radio frequency (RF) source and a ferrofluid source. The apparatus also includes an RF applicator coupled to the RF source and configured to supply RF power to the hydrocarbon resources. The RF applicator includes a plurality of concentric tubular conductors defining ferrofluid passageways therebetween coupled to the ferrofluid source. Accordingly, the apparatus provides increased hydrocarbon processing efficiency, for example, by providing increased cooling and impedance matching.

The ferrofluid source may include a controllable ferrofluid source configured to supply the ferrofluid having a controllable magnetic property. The controllable ferrofluid source may include a particle supply of at least one of ferromagnetic and ferrite particles to the ferrofluid, and a particle separator configured to remove particles from the ferrofluid, for example.

A method aspect is directed to a method of recovering hydrocarbon resources in a subterranean formation. The method includes supplying RF power to an RF applicator in the subterranean formation and coupled to an RF source to recover the hydrocarbon resources. The RF applicator includes a plurality of concentric tubular conductors defining ferrofluid passageways therebetween. The method also includes supplying the ferrofluid having a controllable magnetic property to the ferrofluid passageways.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
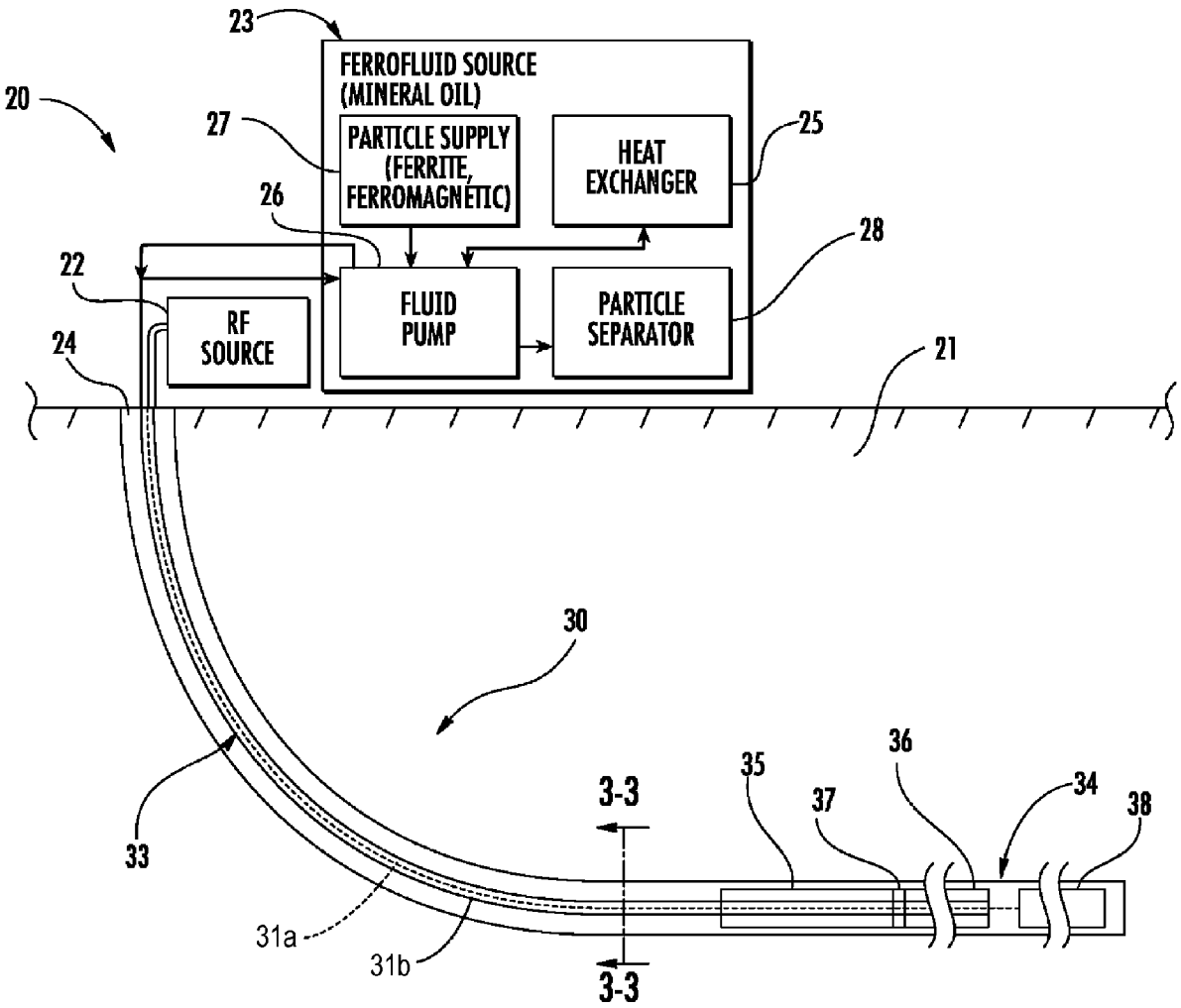
FIG. 1 is a schematic diagram of a subterranean formation including an apparatus for processing hydrocarbon resources in accordance with the present invention.

Referring initially to FIG. 1, an apparatus 20 for processing hydrocarbon resources in a subterranean formation 21 is described. The subterranean formation 21 includes a wellbore 24 therein. The wellbore 24 illustratively extends laterally within the subterranean formation 21. In some embodiments, the wellbore 24 may be a vertically extending wellbore, for example, and may extend vertically in the subterranean formation 21. Although not shown, in some embodiments a second or producing wellbore may be used below the wellbore 24, such as would be found in a SAGD implementation, for collection of petroleum, etc., released from the subterranean formation 21 through heating. The apparatus 20 also includes a radio frequency (RF) source 22, i.e., an RF power source.

Figure 2:
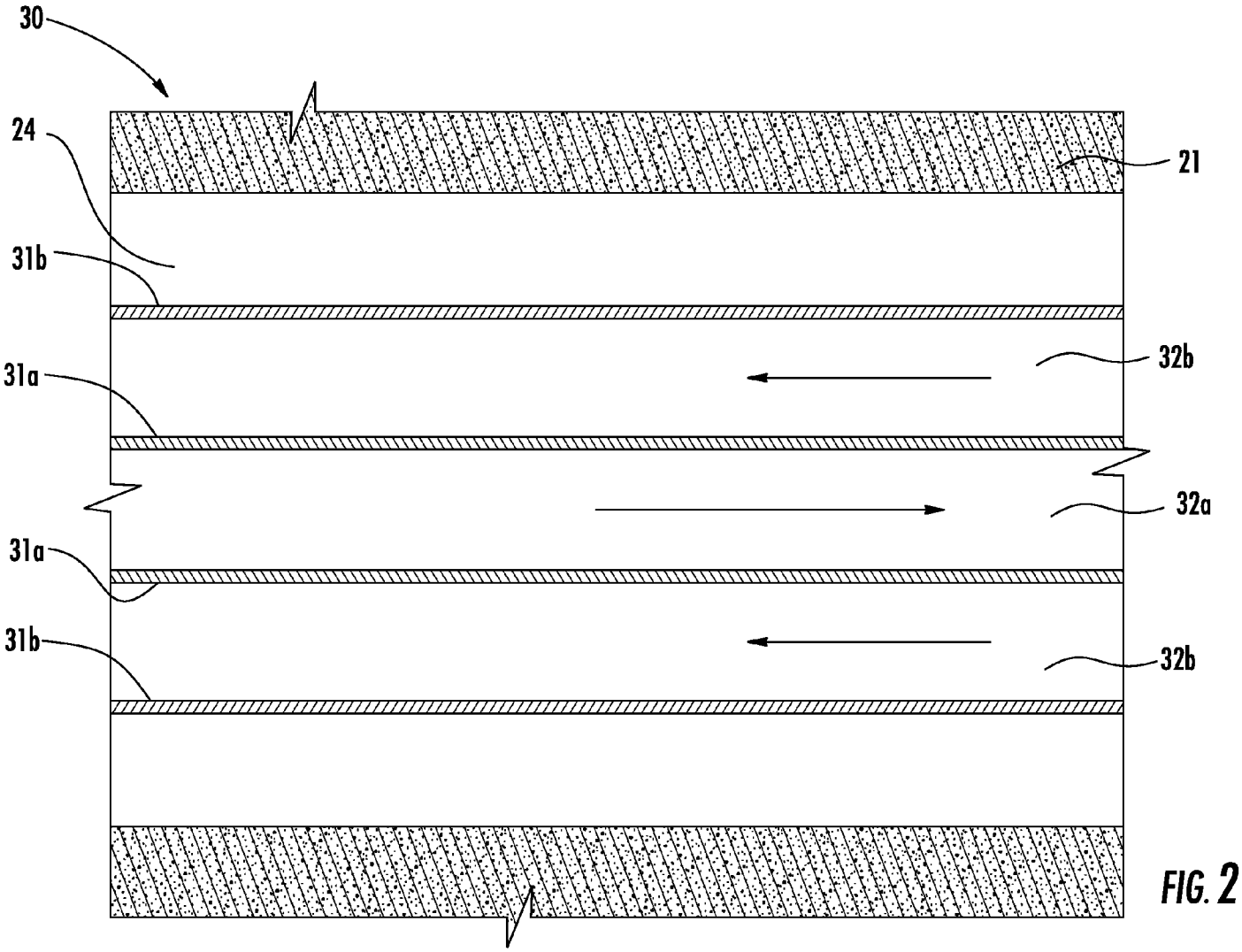
FIG. 2 is a schematic longitudinal cross-sectional view of a portion of the RF applicator of the apparatus of FIG. 1.
Figure 3:
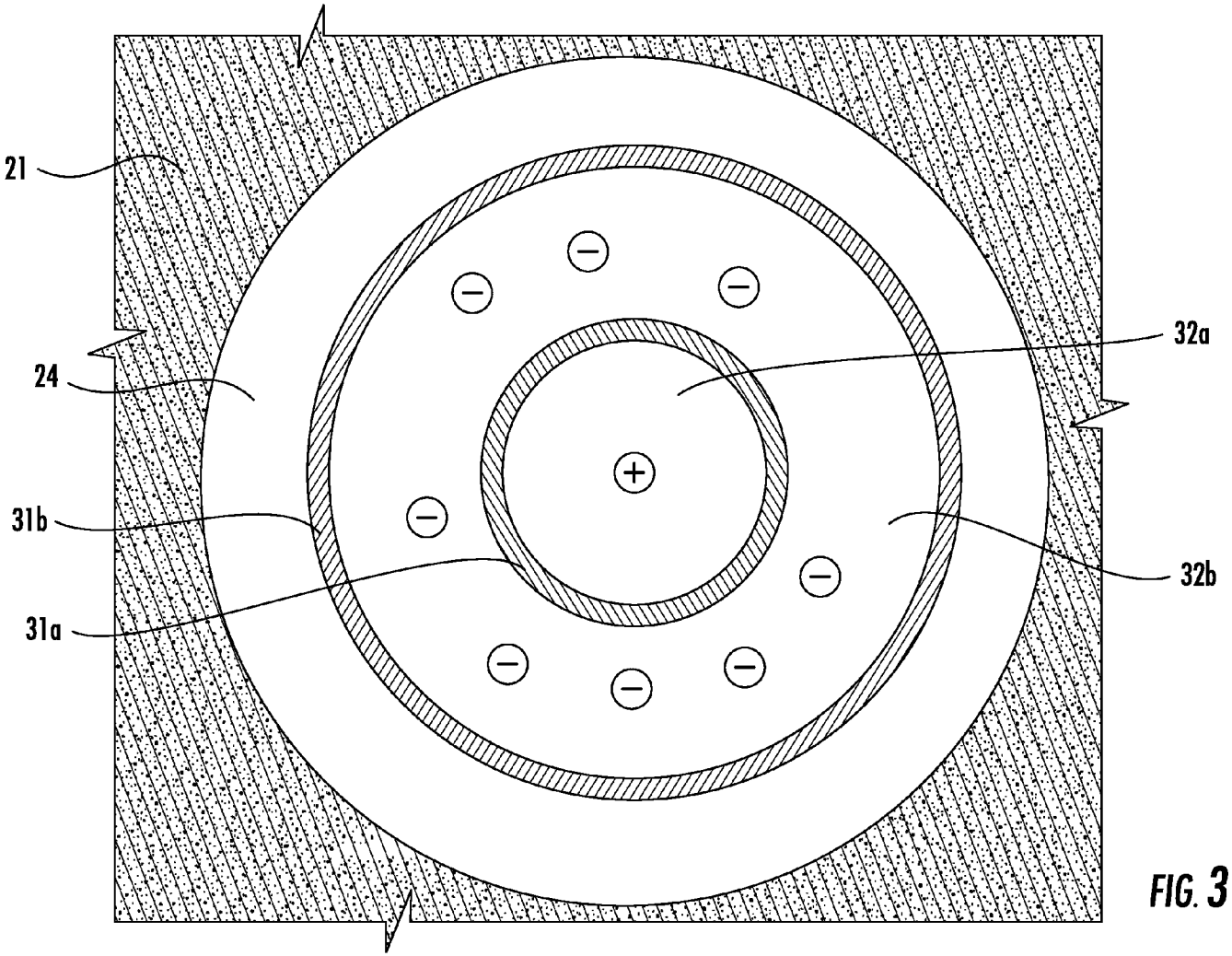
FIG. 3 is a schematic cross-sectional view of a portion of the RF applicator taken along line 3-3 of the apparatus of FIG. 1.

Referring now additionally to FIGS. 2 and 3, an RF applicator 30 is in the subterranean formation 21 and coupled to the RF source 22 to supply RF power to and heat the hydrocarbon resources. The RF applicator 30 includes two concentric tubular conductors 31*a*, 31*b*. The two concentric tubular conductors 31*a*, 31*b* define ferrofluid passageways 32*a*, 32*b* therebetween. The ferrofluid passageways 32*a*, 32*b* are coupled to a controllable ferrofluid source 23. It should be noted that the "+" symbol indicates a liquid flow out of the page, while "−" symbols indicate a liquid flow into the page (FIG. 3). The concentric tubular conductors 31*a*, 31*b* extend laterally within the subterranean formation 21. Of course, in some embodiments, the concentric tubular conductors 31*a*, 31*b* may not extend laterally. Moreover, while two concentric tubular conductors 31*a*, 31*b* are illustrated, the RF applicator 30 may include more than two concentric tubular conductors, for example. It should also be understood that, as used herein, the term concentric may mean that one tubular conductor is within another tubular conductor, and not necessarily that the tubular conductors are mathematically concentric.

The concentric tubular conductors 31*a*, 31*b* of the RF applicator 30 define an RF transmission line 33 in the form of an RF coaxial transmission line. One of the concentric tubular conductors 31*a* advantageously defines the inner conductor of the RF coaxial transmission line 33, and the other of the concentric tubular conductors 31*b* defines the outer conductor of the RF coaxial transmission line. A shielded transmission line may be desirable to reduce unwanted RF heating in the overburden region, as the overburden region is typically more electrically conductive than a hydrocarbon payzone, for example.

Referring particularly to FIG. 1, the RF applicator 30 also includes an RF antenna 34, and more particularly, an RF dipole antenna coupled to a distal end of the RF coaxial transmission line 33. A first electrically conductive sleeve 35 surrounds and is spaced apart from the RF coaxial transmission line 33 defining a balun. A second electrically conductive sleeve 36 surrounds and is spaced apart from the coaxial RF transmission line 33. The concentric tubular conductor 31*b* defining the outer conductor of the RF coaxial transmission line 33 is coupled to the second electrically conductive sleeve 36 at a distal end of the RF coaxial transmission line defining a leg of the RE dipole antenna 34. The second electrically conductive sleeve 36 is spaced from the first electrically conductive sleeve 35 by a dielectric tubular spacer 37. A third electrically conductive sleeve 38 is coupled to the concentric tubular conductor 31*a* defining another leg of the RF dipole antenna 34. Of course, while an RF dipole antenna is described herein, it will be appreciated that other types of RF antennas may be used, and may be configured with the RF transmission line in other arrangements.

It may be desirable to vary the impedance of the coaxial RF transmission line 33. This may be because an impedance of the RF antenna 34 generally varies over time as RF power is applied to the hydrocarbon resources. For increased efficiency, the impedance of the coaxial RF transmission line 33 should be relatively close to, for example, within ±10% of the impedance of the RF antenna 34. Thus, it may be desirable to vary the characteristic impedance of the coaxial RF transmission line 33 after it is positioned within the subterranean formation 21. The electrical characteristics of the subterranean formation 21 may change as the RF heating progresses, varying the impedance of the RF antenna 34.

It may be desirable that the RF antenna 34 provides purely resistive electrical load impedance, as any load reactance would ring the coaxial RF transmission line 33 with reactive currents reflecting back and forth between the RF source 22 and the RF antenna, which may cause excessive losses in the coaxial RF transmission line. The resonance may be tracked by applying sinusoidal only RF power from the RF source 22 and causing the frequency of the RF source to be that of the resonance frequency of the RF source over time. Resonance tracking may cause the RF antenna 34 to provide a nonreactive, resistance only electrical load, e.g. $Z_{antenna}=r+jx\approx r+j0$ ohms.

Circular coaxial transmission lines may be considered optimal, as a circle-shaped cross section provides the most area for the least circumference, which reduces conductor and dielectric losses. While there is increased standardization towards a 50 Ohm characteristic impedance ($Z_0$) coaxial cable, a range of coaxial RF transmission line characteristic impedances may be useful. Increased efficiency, largest voltage rating, and highest power handling occur at different coaxial line characteristic impedances: 77, 60, and 30 ohms respectively. However, for increased efficiency of the apparatus 20, the characteristic impedance $Z_0$ of the RF transmission line 33 should typically always be kept equal to resonant load resistance of the RF antenna 34. Thus, either the resistance of the RF antenna 34 is adjusted or the characteristic impedance of the coaxial transmission line 33 is adjusted, since the electrical characteristics of the subterranean formation 21 may change and as does the impedance of the RF antenna.

The impedance of the coaxial RF transmission line 33 may be determined based upon the equation:

$$Z_0 = \frac{1}{2\pi}\sqrt{\frac{\mu}{\epsilon}}\ln\frac{D}{d}$$

where:

$Z_0$=coaxial cable characteristic impedance;

μ=magnetic permeability of the RF transmission line fill material;

∈=dielectric permittivity of the RF transmission line fill material;

D=diameter of the outer concentric tubular conductor 31*b*; and d=diameter of the inner concentric tubular conductor 31*a*.

Based upon the above equation, increasing the magnetic permeability of the fill increases the characteristic impedance of the coaxial RF transmission line 33. Increasing the dielectric permittivity decreases the characteristic impedance of the coaxial RF transmission line 33.

The controllable ferrofluid source 23 is configured to supply the ferrofluid having a controllable magnetic property. In other words, ferrofluid has a controllable magnetic property which may be changed or adjusted by the ferrofluid source 23. Controlling the magnetic property of the ferrofluid advantageously changes the impedance of the coaxial RF transmission line 33.

To change or adjust the magnetic property of the ferrofluid, the controllable ferrofluid source 23 includes a particle supply 27 for supplying particles. The particles may be ferromagnetic particles, for example. If the ferrofluid media is nonconductive, for example, mineral oil, the ferromagnetic particles may not include an insulating coating, however particles with an insulating coating may be used to increase breakdown voltage Many types of ferromagnetic particles may be used, for example, ferrite powder, powdered iron, neodymium iron boron (NdFeB) powder, nanocrystalline steel in powder form, silicon steel powder, or iron oxide ($Fe_2O_3$). Tradeoffs exist between frequency response, quality factor and efficiency, saturation, magnetization, curie temperature, and grain size, for example. (Penta)Carbonyl iron powder (CIP) type 7248 SQ-I available from the BASF Corporation of Ludwigshafen, Germany is identified for its high saturation magnetization and insulated particle surfaces. PPT FP350 Fully Presintered Ferrite Powder by Powder Processing Technology of Valparaiso, Ind. is identified for relatively nonconductive particles, having a resistivity=$1.0\times10^9$ ohm-cm and tested at scale. Ferromagnetic particles may be washed beforehand to cause insulation coatings, such as a phosphoric acid prewash. If, for example, the desired magnetic property of the ferrofluid, the concentration of particles in the ferrofluid may be increased by adding particles from the particle supply 27.

In testing, the relative magnetic permeability of ferrofluid was found to vary almost linearly with the ferromagnetic particle weight fraction, due to the heavy weight of iron. Particle loadings of up to 50 percent weight fraction were tested in scale models, with trades in the fluid viscosity occurring. Of course, nonmagnetic particles may also be used such as, for example, aluminum oxide, barium titanate, or 3M Glass Bubbles K42HS by Minnesota Mining and Manufacturing Company of Maplewood, Minn. However, at lower radio frequencies, magnetic particles may have more effect. Iron typically offers a much higher relative magnetic permeability than dielectrics offer with respect to relative dielectric permittivity, e.g. $\mu_r >> \in_r$ in practical materials below 10 MHz.

The controllable ferrofluid source 23 also includes a particle separator 28 configured to remove particles from the ferrofluid. If, for example, the desired magnetic property of the ferrofluid, the concentration of the ferromagnetic or ferrite particles may be reduced. The particles may be removed using a cyclonic separation technique, a magnetic trap technique, or other separation technique.

The ferrofluid source 23 also includes a fluid pump 26 coupled to the ferrofluid passageway to circulate the ferrofluid through the ferrofluid passageways 32*a*, 32*b*. A heat exchanger 25 is coupled to the fluid pump 26. The fluid pump 26 may circulate the ferrofluid for cooling of the RF applicator 30, and in particular, the coaxial RF transmission line 33. Advantageously, in addition to varying the impedance, the ferrofluid may be used to cool the coaxial RF transmission line 33 as RF is power supplied.

In particular, as the ferrofluid, which may be mineral oil with ferromagnetic or ferrite particles, for example, is circulated by way of the fluid pump 26 through the cooling passageways 32*a*, 32*b*, heat generated from the RF power is dissipated within the ferrofluid. The heat exchanger 25 removes heat from the ferrofluid as it flows from the subterranean formation 21. Thus, a reduced temperature ferrofluid may remove heat from the RF transmission line 33, for example, while RF power is being applied to the hydrocarbon resources. The ferrofluid may also include glycol-ether, and silicones to reduce foaming. Surfactants such as oleic acid may be added to maintain the particle suspension. Other and/or additional materials may be added.

To test the principles described above, a coaxial test fixture was formed. A 2.635 inch (quarter-wave) long hollow brass rigid coaxial transmission line having a coupling loop defining a transformer winding at a distal end was used. The hollow rigid coaxial cable defined a resonant test cavity. The test cavity resonant frequency was determined based upon the properties of the ferrofluid fill. The coaxial test fixture had a natural resonance of 1274 MHz filled with air and was filled with a neodymium ferrofluid, which had resonant frequency of 660 MHz. A network analyzer was used to measure the impedance, and, more particularly, inductively coupled to the coupling loop.

Figure 4:
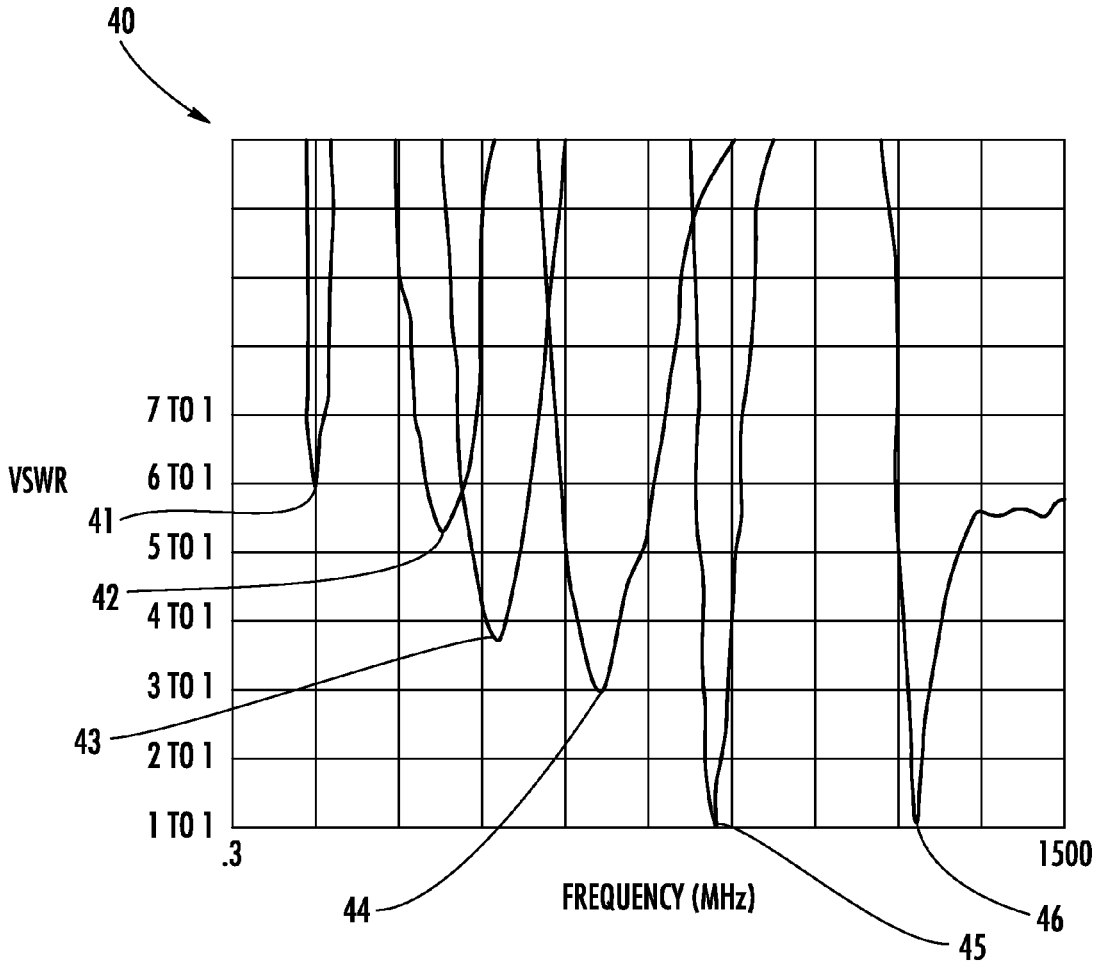
FIG. 4 is a graph of frequency versus VSWR for a coaxial test apparatus along the lines of the apparatus of FIG. 1.

Referring to the graph 40 in FIG. 4, measured resonant frequencies versus voltage standing wave ratio (VSWR) of the coaxial test fixture are illustrated for different ferrofluid fills. In particular, the line 41 at 150 MHz corresponds to tapwater, while the line 42 at 378 MHz corresponds to a 50/50 mixture by weight of Powder Processing Technology PPT FP350 presintered nickel-zinc ferrite powder (powder $\mu_r$=18) and mineral oil. The line 43 at 468 MHz corresponds to a 50/50 mixture by weight of BASF Grade HQ Pentacarbonyl E-iron powder (powder $\mu_r$=7) and mineral oil. The line 44 at 660 MHz corresponds to commercially available neodymium ferrofluid, and the line 45 at 867 MHz corresponds to pure "heavy" mineral oil. Lastly, the line 46 at 1274 MHz corresponds to air. It should be noted that several spurious lines were measured due to stray cabling currents, but are not shown in the graph for ease of understanding.

The following describes the calculation of the ferrofluid magnetic and dielectric loading factors for the coaxial test fixture. To determine the resonance of a quarter-wave coaxial test cavity, the resonant length may first be determined according to:

$$\ell = \frac{\lambda}{4}$$

$$\lambda = \frac{C}{4f}$$

and with ferrofluid loading:

$$\ell = N\frac{C}{4f}$$

$$N = \frac{1}{\sqrt{\mu_r \epsilon_r}}$$

so equating $$\frac{4f\ell}{C} = \frac{1}{\sqrt{\mu_r \epsilon_r}}$$

the magnetodielectric can be calculated as:

$$\left(\frac{C}{4f\ell}\right)^2 = \mu_r \epsilon_r$$

knowing $\in_r$ to be about 2.2 for mineral oil:

$$\mu_r = \frac{\left(\frac{C}{4f\ell}\right)^2}{\epsilon_r^{2.2}}$$

thus, to set the characteristic impedance $Z_0$:

$$Z_0 = \frac{1}{2\pi}\sqrt{\frac{\mu_r \mu_0}{\epsilon_r \epsilon_0}}\,\mathrm{LN}\left(\frac{OD}{ID}\right)$$

where:

$Z_0$=characteristic impedance;

l=length of the coaxial cavity in meters;

C=speed of light in meters/second;

f=frequency at resonance in Hertz;

$\mu_r$=relative permeability (dimensionless) of media;

$\in_r$=relative permittivity (dimensionless) of media;

OD=outer diameter of the coaxial center conductor (meters); and

ID=inner diameter of the coaxial outer conductor (meters).

The calculations of the test using the equations above are summarized in the table below where $\in_r$ is the expected relative permittivity, $\mu_r$ is the measured and calculated relative permeability, OD is the measured outer conductor inner diameter, ID is the measured inner conductor outer diameter, v is the measured coaxial transmission line velocity factor, PR is the calculated percent reduction in calculated coaxial transmission line velocity factor, and $Z_0$ is the calculated cable characteristic impedance in ohms.

| Material | $\epsilon_r$ | $\mu_r$ | OD | ID | v | PR | $Z_0$ |
|---|---|---|---|---|---|---|---|
| Air (control) | 1 | 1.0 | 0.27 | 0.092 | 1.00 | 0 | 64.4 |
| Tapwater (control) | 78 | 1.0 | 0.27 | 0.092 | 0.12 | 170% | 7.3 |
| Mineral Oil | 2.2 | 1.0 | 0.27 | 0.092 | 0.68 | 32% | 43.6 |
| Neodymium Ferrofluid | 2.2 | 1.7 | 0.27 | 0.092 | 0.52 | 48% | 56.7 |
| E-iron - Mineral Oil Ferrofluid | 2.2 | 3.4 | 0.27 | 0.092 | 0.37 | 63% | 79.9 |
| NiZn Ferrite - Mineral Oil Ferrofluid | 2.2 | 5.2 | 0.27 | 0.092 | 0.30 | 70% | 99.0 |

Indeed, coaxial transmission line characteristic impedances were varied from 44 to 99 ohms.

Figure 5:
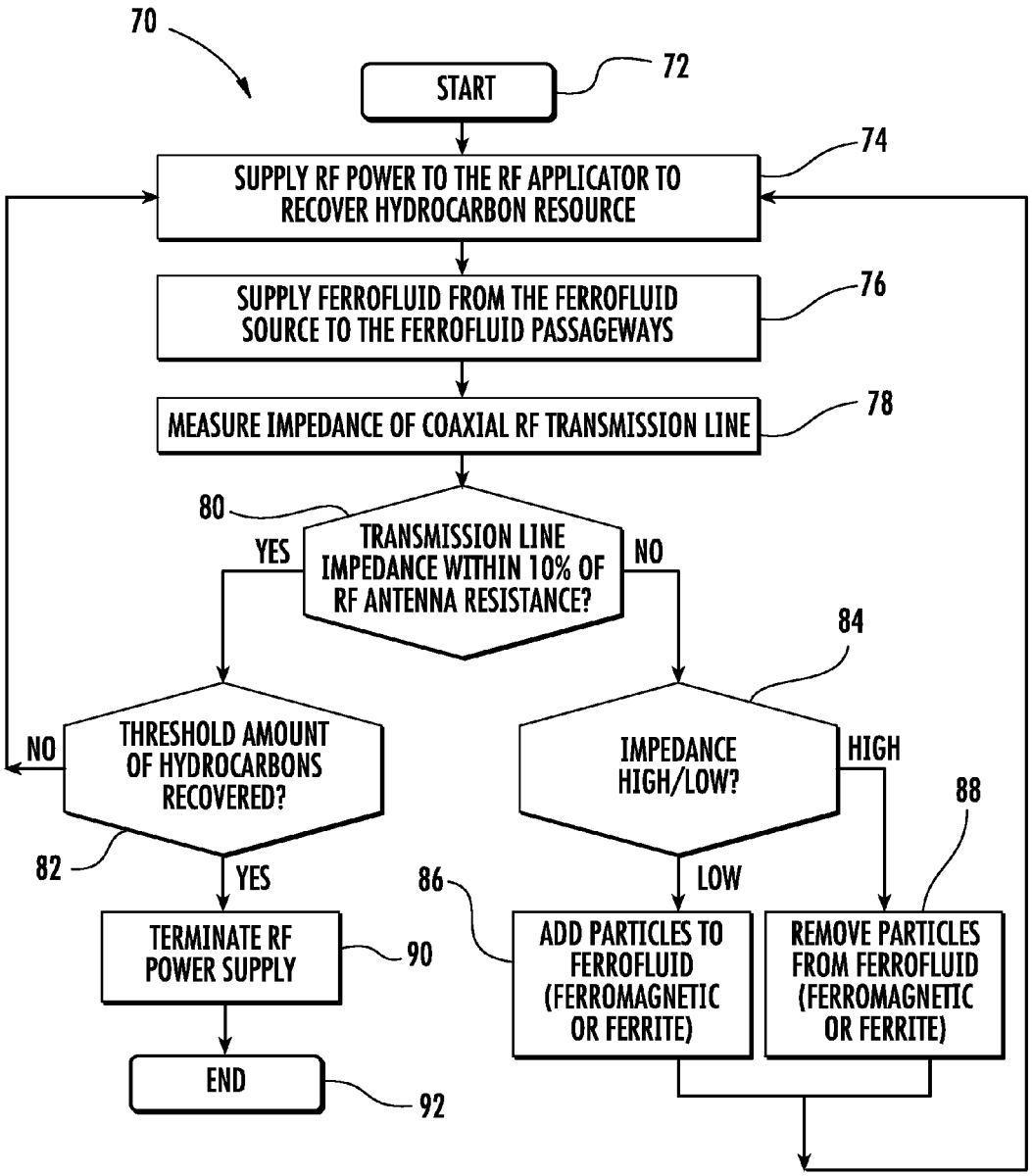
FIG. 5 is a flow chart of a method of recovering hydrocarbon resources according to the present invention.

Referring now to the flowchart 70 in FIG. 5, beginning at Block 72, a method of recovering hydrocarbon resources in a subterranean formation includes supplying RF power to the RF applicator 30 in the subterranean formation 21 and coupled to the RF source 22 to recover the hydrocarbon resources (Block 74).

At Block 76, the method includes supplying the ferrofluid having a controllable magnetic property from the controllable ferrofluid source 23 to the ferrofluid passageways 32*a*, 32*b*. The ferrofluid may be circulated through the ferrofluid passageways via the fluid pump 26. As described above, the ferrofluid advantageously cools the coaxial transmission line 33 when RF power is supplied thereto. The ferrofluid, also as described above, has a magnetic property associated therewith that, in conjunction with the dimensions of the concentric tubular conductors 31*a*, 31*b*, determines the impedance of the coaxial RF transmission line 33.

At Block 78, the electrical impedance of the RF applicator 30, and more particularly, the impedance of coaxial RF transmission line 33 is measured. If the impedance of the coaxial RF transmission line 33 is too low (e.g., outside 10%) relative to the RF antenna 34 (Block 84), particles, for example, ferromagnetic or ferrite particles, are added to the ferrofluid from the particle supply 27 (Block 86). If the impedance of the coaxial RF transmission line 33 is too high relative (e.g., outside 10%) to the RF antenna 34, ferromagnetic or ferrite particles are removed from the ferrofluid (Block 88). The supply of RF power is maintained (Block 74). Indeed, as the subterranean formation 21 and the hydrocarbon resources heat, the impedance of the coaxial RF transmission line 33 changes. Thus, it may be particularly beneficial, as described herein, to adjust the impedance multiple times over the course of recovering the hydrocarbon resources.

If the impedance of coaxial RF transmission line 33 measured at Block 78 is determined to be within ±10%, for example, of the impedance of the RF antenna 34 (Block 80), a determination is made as to whether a threshold amount of hydrocarbon resources have been recovered (Block 82). If the threshold amount of hydrocarbon resources have been recovered, the supply of RF power may be terminated (Block 90). In some embodiments, the operating frequency of the RF source 22 may also be adjusted, for example, to the resonant frequency of the RF applicator for increased efficiency. The method ends at Block 92.

In some embodiments, an isoimpedance coaxial cable fill material may be provided by providing an isoimpedance ferrofluid. Isoimpedance means that the ferrofluid fill does not change or has little effect on the characteristic impedance of the coaxial transmission line from that of an air fill. This may be accomplished by adjusting the relative permittivity to be within ±10% of the relative permeability in the ferrofluid, and, more particularly, equal to the relative permeability, e.g. $\mu_r=\in_r$. The occurrence of isoimpedance may be evident from the relation for coaxial transmission line characteristic impedance:

$$Z_0 = \frac{1}{2\pi}\sqrt{\frac{\mu_r\mu_0}{\epsilon_r\epsilon_0}}\,\mathrm{LN}\left(\frac{OD}{ID}\right)$$

Setting $\mu_r=\in_r$ or within ±10% of each other means that the quantity under the radical is unchanged from that of air, for any value of $\mu_r=\in_r$, as $\mu_r/\in_r\equiv1$ for $\mu_r=\in_r$ in isoimpedance ferrofluid, and $\mu_r/\in_r=1$ for $\mu_r=\in_r=1$ in air. Thus, for example, a ferrofluid fill having $\mu_r=1$ and $\in_r=3$ would cause a coaxial cable to have the same characteristic as an air fill, and a ferrofluid fill having $\mu_r=1$ and $\in_r=20$ would also cause a coaxial cable to have the same characteristic as an air fill. An isoimpedance ferrofluid fill may, for example, be useful to retrofit existing coaxial cables from air to fluid cooling without changing coaxial cable characteristic impedance.

Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for recovering hydrocarbon resources in a subterranean formation comprising:

a radio frequency (RF) source;

a controllable ferrofluid source for a ferrofluid having a controllable magnetic property, said controllable ferrofluid source comprising a particle supply of at least one of ferromagnetic and ferrite particles to the ferrofluid, and a particle separator configured to remove particles from the ferrofluid;

an RF applicator coupled to said RF source and configured to supply RF power to the hydrocarbon resources, said RF applicator comprising a plurality of concentric tubular conductors defining a pair of ferrofluid passageways coupled to said ferrofluid source; and an impedance sensor coupled to said RF applicator and configured to measure an impedance thereof while RF power is being supplied to the hydrocarbon resources;

said controllable ferrofluid source cooperating with said particle supply and said particle separator and being configured to change an amount of particles in the ferrofluid based upon the sensed impedance.

2. The apparatus of claim 1, wherein said controllable ferrofluid source further comprises a fluid pump configured to circulate ferrofluid through the ferrofluid passageways.

3. The apparatus of claim 2, further comprising a heat exchanger coupled to said fluid pump.

4. The apparatus of claim 1, wherein said plurality of concentric tubular conductors define an RF transmission line; and wherein said RF applicator further comprises an RF antenna coupled to said RF transmission line.

5. The apparatus of claim 4, wherein said controllable ferrofluid source is configured to control the magnetic property of the ferrofluid so that an impedance of said RF transmission line is within ±10% of an impedance of said RF antenna.

6. An apparatus for recovering hydrocarbon resources in a subterranean formation comprising:

a radio frequency (RF) source;

a source of controllable ferrofluid configured to supply a ferrofluid having a controllable magnetic property and comprising a particle supply of at least one of ferromagnetic and ferrite particles to the ferrofluid, and a particle separator configured to remove particles from the ferrofluid;

an RF applicator coupled to said RF source to supply RF power to the hydrocarbon resources, said RF applicator comprising a plurality of concentric tubular conductors defining a pair of ferrofluid passageways and coupled to said source of controllable ferrofluid source, and the plurality of concentric tubular conductors defining an RF transmission line, and an RF antenna coupled to the RF transmission line; and an impedance sensor coupled to said RF applicator and configured to measure an impedance thereof while RF power is being supplied to the hydrocarbon resources;

said controllable ferrofluid source cooperating with said particle supply and said particle separator and being configured to change an amount of particles in the ferrofluid based upon the sensed impedance.

7. The apparatus of claim 6, wherein said source of controllable ferrofluid further comprises a fluid pump configured to circulate ferrofluid through the ferrofluid passageways.

8. The apparatus of claim 7, further comprising a heat exchanger coupled to said fluid pump.

9. The apparatus of claim 6, wherein said source of controllable ferrofluid is configured to control the magnetic property so that the impedance of said RF transmission line is within ±10% of the impedance of said RF antenna.

10. A method of recovering hydrocarbon resources in a subterranean formation comprising:

supplying radio frequency (RF) power to an RF applicator in the subterranean formation and coupled to an RF source to recover the hydrocarbon resources, the RF applicator comprising a plurality of concentric tubular conductors defining a pair of immediately adjacent ferrofluid passageways;

measuring, via an impedance sensor coupled to the RF applicator, an impedance of the RF applicator while RF power is being supplied to the hydrocarbon resources;

supplying a ferrofluid having a controllable magnetic property to the ferrofluid passageways; and changing, via a controllable ferrofluid source cooperating with a particle supply of at least one of ferromagnetic and ferrite particles to the ferrofluid and a particle separator configured to remove particles from the ferrofluid, an amount of particles in the ferrofluid based upon the sensed impedance.

11. The method of claim 10, wherein supplying the ferrofluid comprises circulating the ferrofluid through the ferrofluid passageways using a fluid pump.

12. The method of claim 11, further comprising operating a heat exchanger coupled to the fluid pump.

13. The method of claim 11, wherein supplying the ferrofluid having a controllable magnetic property to the ferrofluid passageways comprises supplying a ferrofluid having a relative permeability and a relative permittivity within ±10% of each other to the ferrofluid passageways.

14. The apparatus of claim 1, wherein said controllable ferrofluid source is configured to add the at least one of the ferromagnetic and ferrite particles to the ferrofluid from said particle supply when the impedance is low relative to a desired impedance, and remove particles from the ferrofluid via said particle separator when the impedance is high relative to the desired impedance.

15. The apparatus of claim 6, wherein said source of controllable ferrofluid is configured to add the at least one of the ferromagnetic and ferrite particles to the ferrofluid from said particle supply when the impedance is low relative to a desired impedance, and remove particles from the ferrofluid via said particle separator when the impedance is high relative to the desired impedance.

16. The method of claim 10, wherein the amount of particles in the ferrofluid are changed by at least adding the at least one of the ferromagnetic and ferrite particles to the ferrofluid from the particle supply when the impedance is low relative to a desired impedance, and removing particles from the ferrofluid via the particle separator when the impedance is high relative to the desired impedance.

* * * * *